US005915646A

United States Patent [19]

Campbell

[11] Patent Number: 5,915,646

[45] Date of Patent: Jun. 29, 1999

[54] CART FOR CARRYING SPOOLS OF WIRE AND UTILITY TRAYS

[76] Inventor: William F. Campbell, 4003 Charles St., Rockford, Ill. 61108

[21] Appl. No.: 09/172,829

[22] Filed: Oct. 15, 1998

[51] Int. Cl.[6] ..... B65H 16/02

[52] U.S. Cl. ..... 242/594.4; 242/594.6; 242/403.1; 242/404; 280/47.17

[58] Field of Search ..... 242/594.4, 594.6, 242/588, 403.1, 404, 400; 280/47.34, 47.35, 47.131, 47.18, 47.19, 47.17

[56] References Cited

U.S. PATENT DOCUMENTS

| | | | |
|---|---|---|---|
| 875,476 | 12/1907 | Wasson | 242/557 |
| 1,660,521 | 2/1928 | Nordgren | 211/70.6 |
| 2,155,769 | 4/1939 | Porter | 242/598.3 |
| 2,705,114 | 3/1955 | Worsham | 242/594.4 |
| 4,179,080 | 12/1979 | Patnaude | 242/86.52 |
| 4,391,422 | 7/1983 | MacDonald | 242/129.6 |
| 4,457,527 | 7/1984 | Lowery | 280/47.19 |
| 4,564,152 | 1/1986 | Herriage | 242/86.5 |
| 4,605,237 | 8/1986 | Torgrimson | 280/47.24 |
| 4,901,937 | 2/1990 | Mendoza | 242/86.5 R |
| 5,308,012 | 5/1994 | Fuller | 242/86.5 R |
| 5,509,671 | 4/1996 | Campbell | 280/47.19 |
| 5,595,395 | 1/1997 | Wilson | 280/47.26 |
| 5,615,902 | 4/1997 | Reurich | 280/47.18 |
| 5,687,928 | 11/1997 | Lassiter | 242/557 |

*Primary Examiner*—Donald P. Walsh
*Assistant Examiner*—Minh-Chau Pham
*Attorney, Agent, or Firm*—Leydig, Voit & Mayer, Ltd.

[57] ABSTRACT

A cart adapted to carry utility trays for tools, fasteners, materials, and a plurality of wire spools from place to place. The cart include racks for selectively holding spools and trays. The cart can be translated between upright and substantially horizontal positions without emptying the contents in the tray onto the ground. The tray is pivotally supported by the cart so that the tray remains upright as the cart is translated between upright and substantially horizontal positions. The cart is also supported by an increased base provided by an extension plate extending forwardly from the cart, to thereby provide greater stability and facilitate use of the cart with relatively large diameter wire spools.

12 Claims, 4 Drawing Sheets

CART FOR CARRYING SPOOLS OF WIRE AND UTILITY TRAYS

FIELD OF THE INVENTION

The invention relates generally to a device adapted to hold multiple spools of wound material for selective dispensing or unwinding of the material from the spools. More particularly, the invention relates to a portable cart adapted to carry multiple spools of electrical wire.

BACKGROUND OF THE INVENTION

Wire installation at building work sites is normally done in three steps. First, the electrical conduits and boxes are installed to the frame of the building. Then, wire is pulled through the boxes and conduits. Lastly, the wire is cut and fixtures and terminals are connected to the wire. It will be appreciated to those skilled in the art that these three steps require a substantial amount of labor which in turn reflects on the overall cost of accomplishing a wire installation job.

In my previous invention, U.S. Pat. No. 5,509,671, (hereinafter referred to as the '671 patent) the entire disclosure of which is hereby incorporated by reference, I disclosed a portable cart for carrying multiple spools of wire which substantially reduces the labor required for the step of wire pulling, and therefore the overall cost of accomplishing a wire installation job. The portable cart organizes multiple spools of wire and provides for easier transportation and dispensing of the wire spools. Several conductors of wire can easily and simultaneously be pulled from differently sized spools held by the cart. Electricians have found the cart to be very beneficial as it reduces the number of trips between storage locations and work-sites. The number of man-hours and cost of wire installation are also greatly reduced through the use of the '671 invention. The invention has also eliminated or reduced the number of wire spools laying around a work-site which can be hazardous or inconvenient to workers in the vicinity.

While the '671 patent has been met with considerable commercial success and has reduced the labor costs associated with the wire pulling step. A need currently exists for an apparatus to hold tools and associated materials such as switches, switch plates, receptacles, and the like on the cart and in so doing further reduce the time required for the wire installation job. Electricians currently need to make multiple trips around the work site or to storage locations to locate the necessary tools and materials necessary for completing the installation. This results in less than efficient work which increases the labor costs associated with a wire installation job.

SUMMARY OF THE INVENTION

It is therefore a general aim of the present invention to increase the efficiency of electricians at a work site and therefore reduce associated labor costs.

It is therefore another aim of the present invention to provide better access to tools, fasteners, and associated materials for those who use a portable wire cart.

It is therefore an object to provide a spill-resistant utility tray for a portable cart.

It is another object of the present invention to provide a portable cart with racks that can be readily used for interchangeably holding wire spools or trays of fasteners, tools and materials.

It is another object of the present invention to provide a tray that can easily be removed from the cart and carried to remote locations.

It is therefore a feature of the present invention to provide a portable cart that provides racks, or other securing means, for carrying spools of wire and utilities trays for holding fasteners, tools, and materials. In the preferred embodiment, a single tray is pivotally mounted to the cart to prevent emptying of the tray during translation of the cart between upright and substantially horizontal positions. The tray provides convenient access to tools, fasteners, and materials for electricians and other workers who use the portable cart. The tray also may be releasable from the cart so that the tray can be carried to remote locations away from the cart.

It is another feature of the present invention that the tray is connectable to one of the racks for holding spools of wire. According to this feature, the tray has laterally spaced side support walls with mounting holes that readily interfit with the support rods of the racks. The support rod for the tray may be bent in an arcuate shape to provide a removable tray with the arcuately shaped rod providing a carrying handle.

It is a related feature of the present invention to provide a cart which will facilitate the handling of the larger diameter spools. Accordingly, an extension plate extends the forward length of the cart, while the wheels are of increased diameter to thereby increase the rear base of the portable cart. This provides further support and enhances stability of the cart to thus expand its utility to larger diameter spools.

These and other aims, objects and features of the invention will become more apparent from the following detailed description when taken in conjunction with the accompanying drawings.

Figure 1:
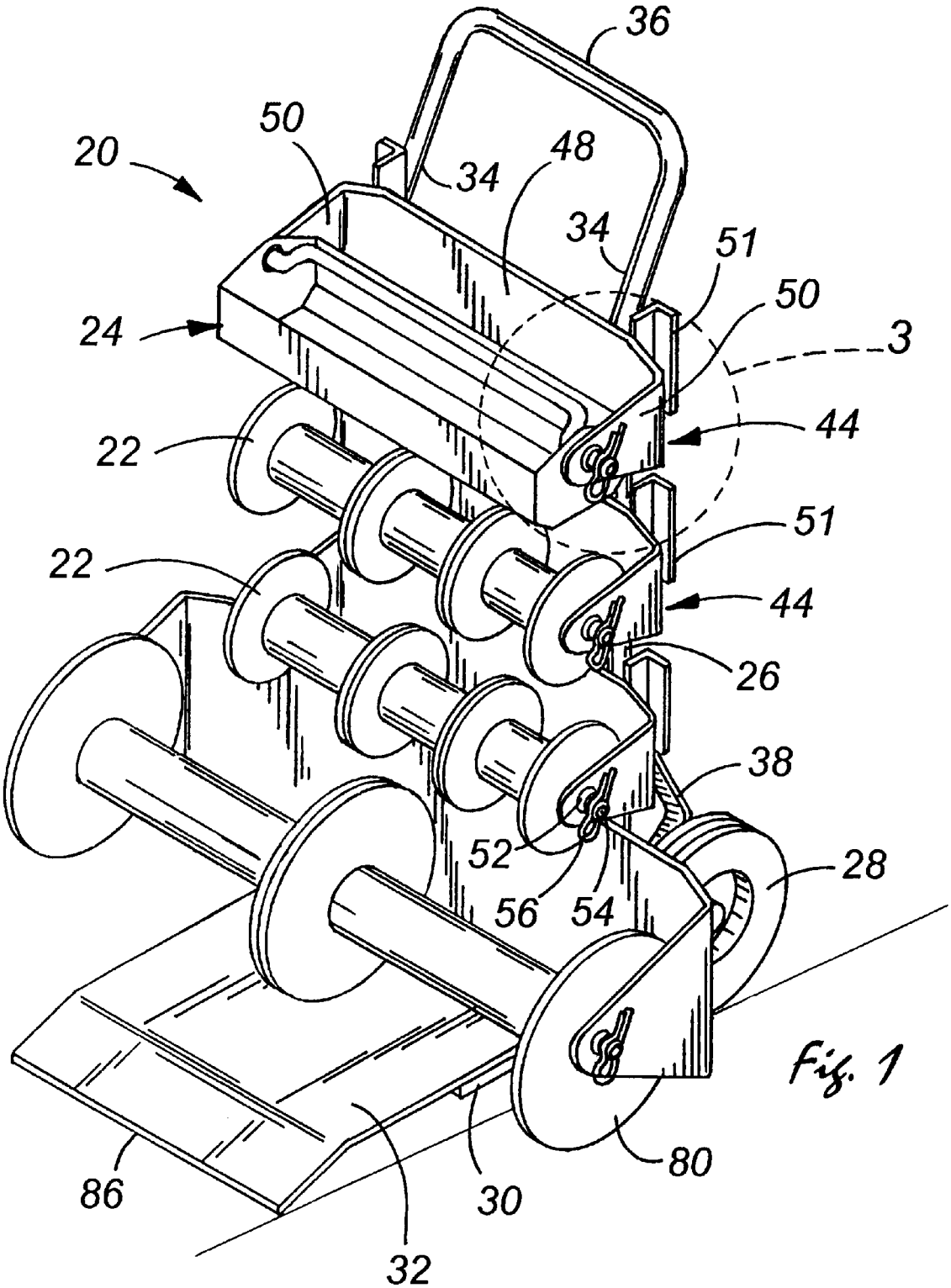
FIG. 1 is a perspective view of a portable wire cart in an upright position according to a preferred embodiment of the present invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

Figure 2:
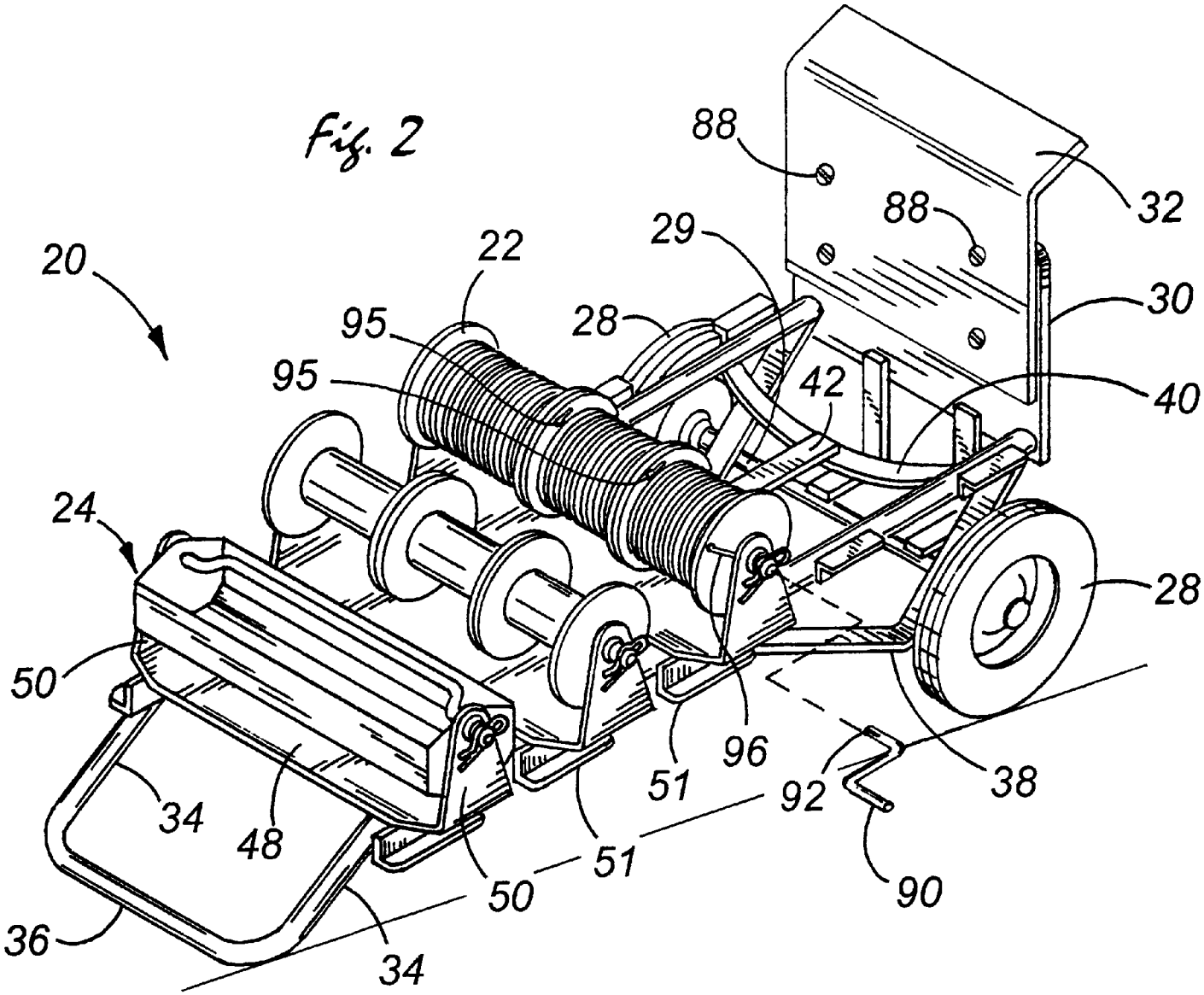
FIG. 2 is a perspective view of the portable cart of FIG. 1 in a substantially horizontal position with the lower rack removed.

For purposes of illustration and referring to FIG. 1, the preferred embodiment of the present invention is shown as embodied in a portable cart 20 adapted to carry wire spools 22 and a utility tray 24 for holding tools and fasteners. The cart 20 can be pivotally translated between an upright position as shown in FIG. 1 and a substantially horizontal position as shown in FIG. 2. For purposes of explaining the invention, the cart will be assumed to be in an upright position, except where otherwise noted.

In general, and referring to FIGS. 1 and 2, the cart 20 includes an elongated and generally vertical frame 26, a pair of laterally spaced wheels 28 pivotably connected to a solid axle 29 by bearings (not shown) for rotation relative to the frame 26, and a platform 30 which extends forwardly from the base of the frame 26. The wheels 28 are positioned rearwardly of the frame and near the base of the frame so that the wheels 28 normally rest on the ground. The platform 30 is coupled to an extension plate 32 which also rests on the ground and coacts with the wheels 28 to support the cart 20 in the upright position. By pivoting the upper portion of the frame 26 rearwardly and downwardly about the wheels 28, the platform 30 and extension plate 32 can be lifted off the ground and the cart 20 can be readily rolled between locations.

The frame 26 is formed from relatively heavy gauge steel to support the load on the cart 20. The frame 26 includes vertically extending, elongated side rails 34 and an integrally formed handle 36 which extends generally rearwardly from, and laterally between, the side rails 34. The axle 29 is welded to axle support members 38 which, in turn, are welded to the backside of the side rails 34. Vertically spaced cross-support members 40 welded between the side rails 34, and a vertically extending support member 42 welded to and connecting the cross-support members 30, provide additional structural support to the cart 20.

The side rails 34 generally provide multiple pairs of vertically spaced support brackets 43 (FIG. 3) (each pair being generally horizontally aligned) that carry releasable racks 44 for holding wire spools 22, as is also disclosed and explained in my previously disclosed invention, U.S. Pat. No. 5,509,671. Each rack 44 generally includes a laterally extending back panel 48 and two side panels 50 extending forwardly therefrom. The back panel 48 provides support members 51 which rest on the support brackets 43 of the frame. As may be seen better in FIG. 3, the side panels 50 provide openings 52 with metal tubes 54 fitted through the openings 52 for selectively supporting the tool tray 24 or wire spools 22. The metal tubes 54 are secured by hitch pins 56 fitted through holes formed in the ends of the tubes 54, which extend outside the side panels 50.

Figure 3:
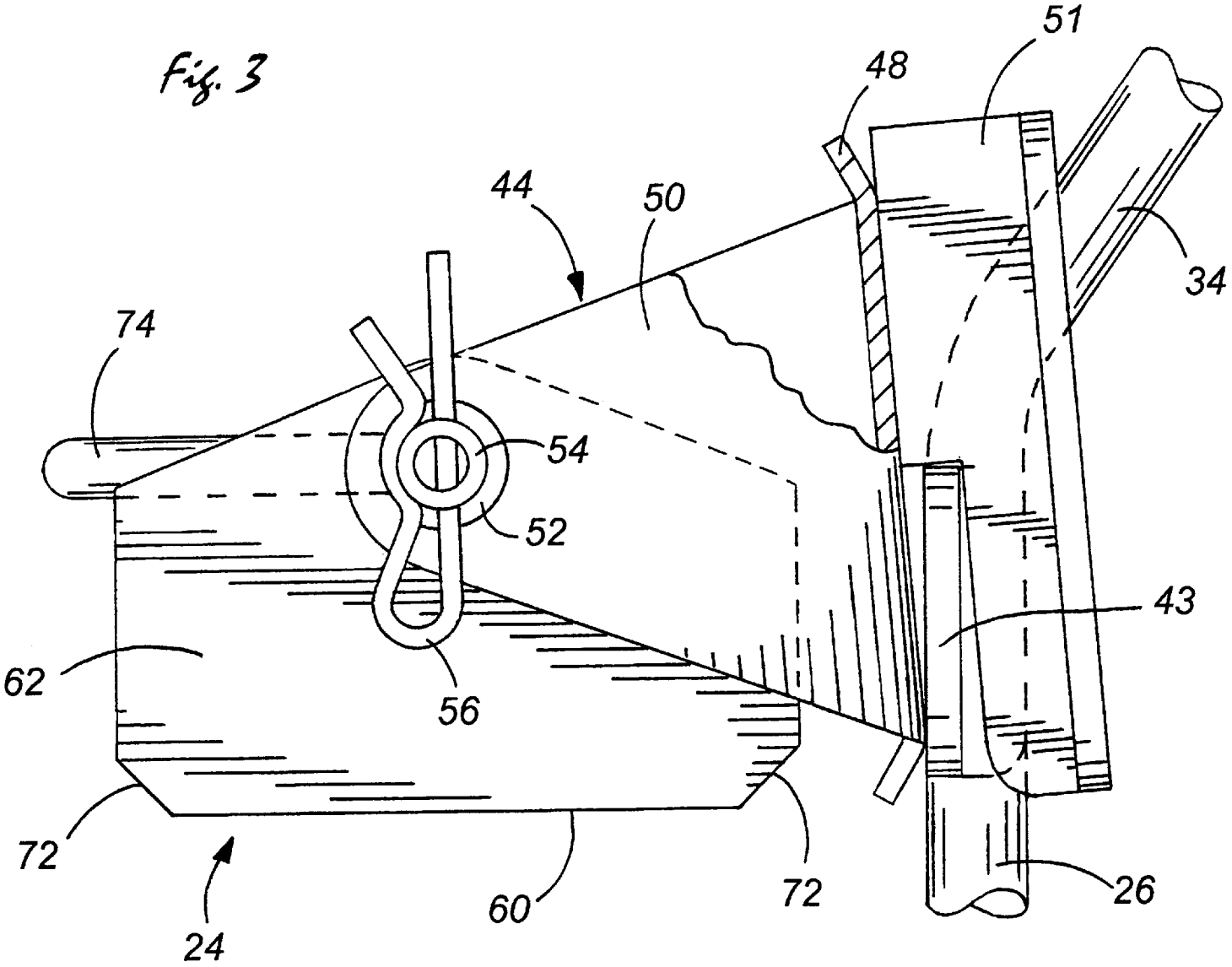
FIG. 3 is a fragmentary side view the area indicated by area 3 shown in FIG. 1.
Figure 4:
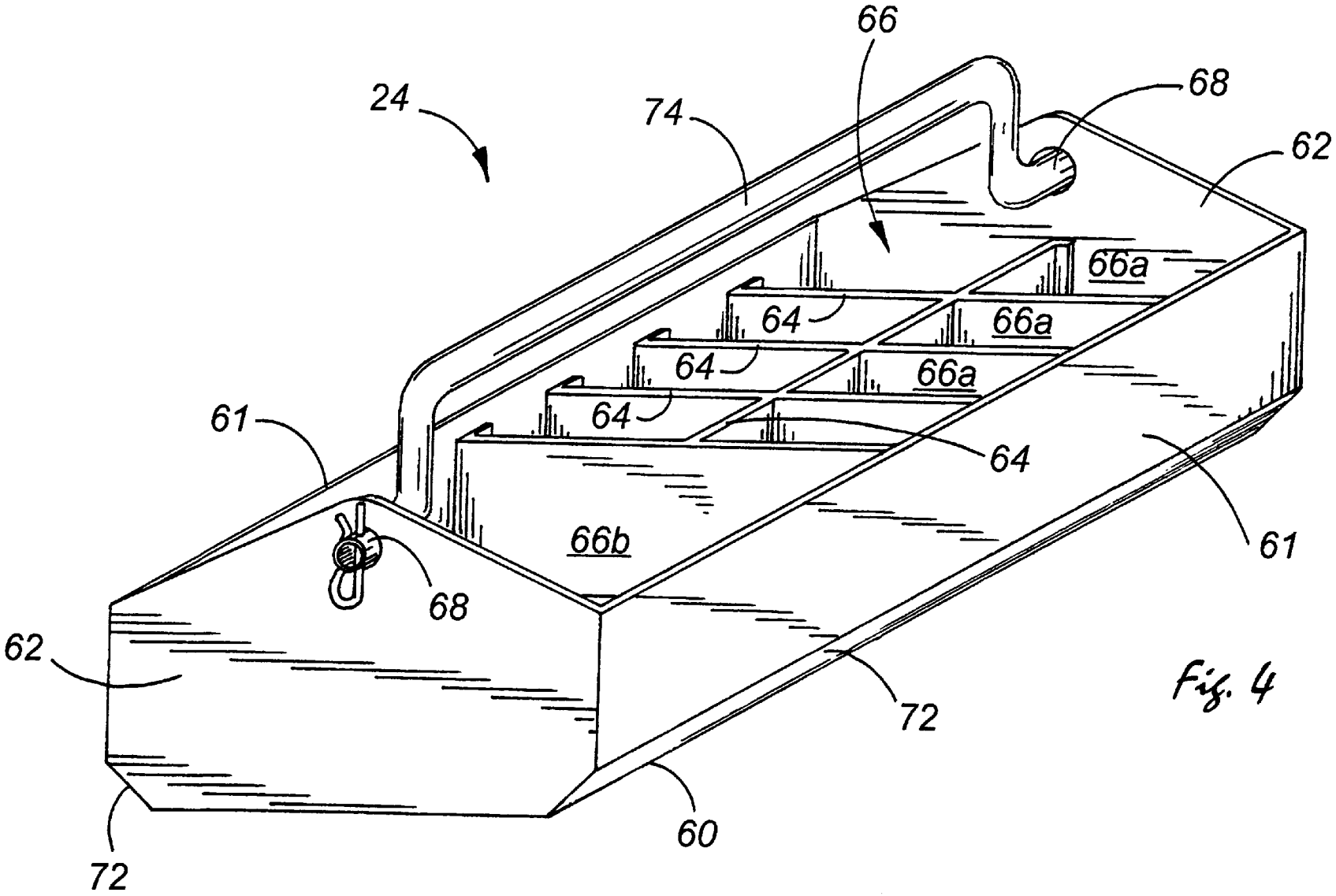
FIG. 4 is a perspective view of the utility tray of the preferred embodiment of the present invention.

In accordance with the objective of providing a spill-proof tool tray for a mobile cart, the preferred embodiment provides a removable utility tray 24 that is pivotally mounted on a rack 44 to prevent emptying of the contents therein. Referring now to FIGS. 3 and 4, the utility tray 24 generally has a flat rectangular bottom surface 60 for supporting contents in the tray 24. Extending vertically upward from the bottom surface 60 are a pair of laterally spaced support walls 62 for support of the tray 24. A pair of outer walls 61 are disposed transversely between the support walls 62 to form one enclosed rectangular box-like compartment, generally indicated at 66. The tray 24 may also include partition walls 64 attached between the outer and support walls 61, 62 for forming a desired number of smaller compartments in the tray. The preferred embodiment of the tray 24 shows a number of smaller compartments 66*a* for holding fasteners such as butt-splices, screws, connectors and the like and a larger compartment 66*b* for holding tools and materials such as switches, switch plates, receptacles, and the like.

Each of the side support walls 62 provides an opening 68 that receives a metal tube 54 for connection to a selected one of the racks 44. As seen in FIG. 3, the metal tube 54 may be fitted through the side panel openings 52 to pivotally connect the tray 24 to the rack 44. As is generally seen, the openings 68 are located above the center of gravity for the tray 24 and are approximately horizontally centered with the center of gravity for the tray 24. By providing this location for the openings 68, gravity ensures that the bottom surface 60 is always substantially parallel with the ground so that contents in the tray 24 do not fall out by rotation of the cart 20 between upright and substantially horizontal positions. In comparing FIGS. 1 and 2, it may be seen that the tray 24 rotates to automatically remain upright as the cart 20 is pivoted from upright to substantially horizontal positions.

In the preferred embodiment and referring to FIGS. 3 and 4, the tray 24 also includes beveled surfaces 72 where the outer walls 61 and the bottom surface 60 meet to provide enough clearance so that the tray 24 does not hit the back panel 48 of the rack 46 as the cart 20 is transferred between upright and substantially horizontal positions. The beveled surfaces 72 are preferably provided at both the forward and rearward edges of the bottom surface 60 so that the tray 24 is reversible and thus may not accidentally be mounted the wrong way on the rack 44. The beveled surfaces 72 generally allow for a larger sized tray 24. By providing the pivotally mounted utility tray 24, the portable cart 20 reduces the number of toolboxes and trays electricians carry around at a work-site, and provides convenient access for commonly used items at a work-site. This feature thereby improves overall work efficiency.

In accordance with the objective of providing interchangeability between tool trays and wire spools on a cart, each rack 44 may be used either for a tray or for wire spools 22. In keeping with the invention, the metal tube 54 for the tray 24 is bent to include an arcuately shape portion to form a metal tube carrying handle 74 for when the tray is removed from the rack as seen in FIG. 4. The carrying handle 74 normally couples the tray 24 to the rack 44 and rests on the outer walls 61. However, the tray 24 is also easily releasable from the rack by undoing the hitch pins 56 at the ends of the metal tube handle 74. The tray 24 can then be removed from the rack 44 by sliding the one end of the handle 74 out of its corresponding opening 52 and then manipulating the tray 24 away from the rack 44. The openings 52 in the rack side panels 50 are sized slightly larger than the diameter of the metal tube of the handle for easy removal of the tray 24 from the rack 44.

Referring again to FIG. 1, it may also be seen that the cart 20 may be specially adapted to accommodate larger sized wire spools 80, preferably on lower racks of the cart 20. In comparison to my previous invention disclosed in '671 patent, in the preferred embodiment of the present invention the diameters of the wheels 28 have been increased from eight inches to ten inches, with the wheel positioned further back approximately an inch and up an inch in the preferred embodiment. This provides better support for the cart 20 in the upright position. The platform 30 has also been extended by means of the extension plate 32 which extends forwardly from the platform 30. The extension plate 32 is coupled to the platform by four beveled set screws 88. The extension plate 32 is also bent at an obtuse angle to lift the platform off the ground so as to provide a more solid base provided by the wheels and the foremost edge 86 of the extension plate. By providing a solid base, tools, fasteners, and materials are also less likely to spill out of the tray 24. It will be appreciated by workers and electricians that much time can be saved not only by providing ready access to such items, but by also ensuring such items remain in the cart until needed, even when utilizing relatively large diameter spools.

Another advantage of the preferred embodiment shown in the FIG. 2, is a crank lever arm 90, which can be conveniently stored in the tray 24, for winding wire onto the spools 22. For example, after wire has been pulled for installation, the crank arm can be used to quickly rewind the unused portion of the pulled, but unused, wire onto the spool. The crank lever arm 90 includes two perpendicular bends and includes a slit end 92 so that the crank lever arm can be fitted onto one of the hitch pins 56 for rotating the metal tubes 54. By connecting wire spools 22 to the metal tube 54, by means of an inside hole (not shown) drilled into the metal tube 54 and a bent connection pin 96 connecting the spool 22 to the tube 54, the torque is transferred from the crank lever arm 90 to the wire spool 22. Also, multiple spools can be wound at the same time by fastening spools together by wire portions 95 or other fastening means.

What is claimed is:

1. A portable cart for carrying spools of wire and utility trays, the cart comprising:

an elongated frame adapted to be moved from an upright position to a substantially horizontal position, the frame having upper and lower end portions when it is in the upright position, the upper end portion being pivoted about the lower end portion to move the frame between the upright and substantially horizontal positions;

at least two wheels mounted near the lower end portion of the frame for rotation relative to the frame, the wheels resting on the ground such that the cart is mobile;

means for releasably securing the spools of wire to the frame, the securing means being adapted to allow rotation of the spools relative to the frame for unwinding wire from the spools; and a tray having a bottom surface and sidewalls extending upward from the bottom surface to form at least one compartment, the tray being pivotally supported on the portable cart in a position where the bottom surface is substantially parallel to the ground, the bottom surface being maintained substantially parallel to the ground as the frame is pivoted between upright and substantially horizontal positions the tray and the spools being interchangeable.

2. The portable cart as in claim 1 wherein the tray is releasable from the cart so that the tray may be carried to remote locations from the cart.

3. The portable cart as in claim 1 wherein the at least two wheels are connected by an axle, the axle being mounted rearwardly the frame near the lower end whereby the axle is below the frame in the substantially horizontal position, and wherein a platform and an extension plate coupled to the platform extend forwardly from the bottom end portion of the frame for holding the portable cart in the upright position, the extension plate have a forward portion that is bent at an obtuse angle so that the platform is lifted off the ground when the cart is in the upright position.

4. The portable cart as in claim 1 wherein the wheel has diameter greater than nine inches.

5. The portable cart as in claim 1 further comprising a crank lever arm connectable to said securing means for winding wire onto spools mounted on the portable cart.

6. A portable cart for carrying spools of wire and utility trays, the cart comprising:

a substantially vertical frame having two vertically extending side rails laterally spaced from one another;

at least two wheels mounted on the frame for rotation relative to the frame, the wheels resting on the ground such that the cart is mobile;

a plurality of vertically spaced pairs of support brackets extending from the side rails, the support brackets of each pair being laterally aligned with one another;

a plurality of vertically spaced racks adapted to carry spools, each rack having a laterally extending back panel and a pair of side panels extending forwardly from the back panel, each rack having a rod interposed between the side panels and means for releasably securing the rod to the side panels, each rack further having a pair of support members extending rearwardly from said back panel, the support members being adapted to rest on the support brackets such that the rack is releasably secured to and is selectively removable from said frame; and a tray having a bottom surface and sidewalls extending upwardly from the bottom surface to form at least one compartment, the tray being releasably mounted to one of the racks, the tray and the spools being interchangeable.

7. The portable cart of claim 6 wherein the sidewalls include two lateral support walls, a rod of a selected rack being connected through the support walls to secure the tray to the rack.

8. The portable cart of claim 7 wherein the sidewalls further include a pair of outer walls disposed transversely between said two lateral walls, the outer walls being connected to the bottom surface by a beveled surface to allow rotation of the tray relative to the rack supporting the tray.

9. The portable cart of claim 7 wherein the rod for the tray includes arcuately formed portions so that the rod provides a handle for carrying the tray when the tray is disconnected from a rack.

10. The portable cart of claim 6 further comprising a crank lever arm connectable to the rods of the racks for rotating the rods, and a pin connecting at least one spool to the rod whereby rotation of the crank lever arm can wind wire onto the spools.

11. The portable cart of claim 10 further comprising means for connecting several spools on one rack.

12. The portable cart of claim 6 wherein said at least one compartment includes a plurality of variably sized compartments so that the tray is adapted to hold fasteners and tools.

* * * * *